United States Patent [19]

Bruns et al.

[11] Patent Number: 4,555,308

[45] Date of Patent: Nov. 26, 1985

[54] GAS COLLECTING HOOD FOR COLLECTING EMISSIONS DURING COKE DISCHARGE OPERATIONS

[75] Inventors: Engelbert Bruns, Recklinghausen; Gerd Osterholt, Dorsten, both of Fed. Rep. of Germany

[73] Assignee: Firma Carl Still GmbH & Co. K.G., Fed. Rep. of Germany

[21] Appl. No.: 633,862

[22] Filed: Jul. 24, 1984

[30] Foreign Application Priority Data

Jul. 27, 1983 [DE] Fed. Rep. of Germany ..... 3326971

[51] Int. Cl.[4] ..... C10B 33/14; C10B 27/00

[52] U.S. Cl. ..... 202/263; 414/212

[58] Field of Search ..... 202/263, 269; 414/212

[56] References Cited

U.S. PATENT DOCUMENTS

| | | | |
|---|---|---|---|
| 3,839,161 | 10/1974 | Pries | 202/263 |
| 3,844,900 | 10/1974 | Schulte | 202/263 |
| 4,141,796 | 2/1979 | Clark et al. | 202/263 |
| 4,448,642 | 5/1984 | Lucas | 202/263 |

FOREIGN PATENT DOCUMENTS

| | | | |
|---|---|---|---|
| 1812897 | 6/1970 | Fed. Rep. of Germany . | |
| 2812890 | 10/1979 | Fed. Rep. of Germany | 202/263 |
| 2938893 | 4/1981 | Fed. Rep. of Germany | 202/263 |
| 3115217 | 11/1982 | Fed. Rep. of Germany . | |

*Primary Examiner*—Peter Kratz

*Attorney, Agent, or Firm*—McGlew and Tuttle

[57] ABSTRACT

A gas collecting hood for taking off emissions from coke being pushed out of coke oven chambers, travels along with a coke guide alongside the battery. The hood is connected through a gas collecting duct to a stationary exhausting system. The hood is supported at three points, through roller (15,16) at two points (A,B) on a rail (11) which is provided at the hood side remote from the coke guide (3), and pivotally at a point (C) on the coke guide (3).

4 Claims, 3 Drawing Figures

GAS COLLECTING HOOD FOR COLLECTING EMISSIONS DURING COKE DISCHARGE OPERATIONS

FIELD AND BACKGROUND OF THE INVENTION

The present invention relates in general to coke ovens, and in particular to a gas collecting hood for collecting emission during the discharge of coke.

A hood of this kind is known from German OS No. 31 15 217 (U.S. Pat. No. 4,448,642), for example. That prior art hood is supported only on its side remote from the coke guide, namely on two rails at different levels on which the hood travels alongside the coke oven battery. Because of the unilaterally overhanging part of the hood, the rails must be propped in a very stable manner.

Further known, from German OS No. 18 12 897, is a hood separately travelling on rails which are provided at the left and the right of the rails on which the quenching car moves. Consequently, an additional rail for the hood extends between the point of support on the service passageway, and the rails for the quenching car. This requires a very expensive lower supporting frame of the hood, since the height of the quenching car is considerable. In addition, no space is left for a rail for the hood itself, because of the amount of equipment between the point of support on the service passage and the rails of the quenching car.

Finally, hoods are known which are firmly connected to the coke guide and bear, on one side, against the guide and, on the other side, against a rail of their own provided at this side remote from the coke guide. With such constructions, a separation of the hood from the coke guide is expensive. No quick change from one coke guide to the other, or from one hood to the other, is possible.

SUMMARY OF THE INVENTION

The present invention is directed to a simple support and backing-up of a hood of the above mentioned kind requiring no expensive fixing of the rails and permitting a quick engagement and disengagement between the hood and the coke guide.

Accordingly an object of the present invention is to provide a gas collecting hood for collecting emissions during a coke discharging operation from a coke oven, which travels along with a coke guide for guiding coke from the coke oven, the coke guide being mounted for movement in the longitudinal direction across a coke oven battery containing a plurality of coke ovens, the hood being connected through a gas collecting duct to a stationary exhaustion system, and wherein the gas collecting hood is supported at three points, two of the points of the support (A,B) bearing through rollers against a rail which is remote from the coke guide, and one of the points being a pivotal bearing connection on the coke guide.

The inventive hood bears at two points against a rail, through the travelling gear, and at one point against the coke guide, preferably pivotally, through a bearing socket or a similar device. The stability of the three point-supported hood is obtained by a correct positioning of the centers of gravity in the support frame of the hood. In contradistinction to conventional hoods supported on the coke guide or the service passageway and separable therefrom only in a complicated manner the inventive hood can be separated from the coke guide very simply and easily by lifting with the aid of a hoist in the area of a supporting point (C). To be sure, due to the support on the coke guide, the hood structure cannot travel independently of the coke guide, however, the advantage obtained is that no expensive construction of a track for an independent hood is needed.

The travelling speed of the inventive hood is advantageously controlled with the aid of a skew travel sensor, through an electrical control system. The sensor is designed at the same time as a skew travel limiting mechanism. With the inventive three point support of the hood, problems are avoided which necessarily occur particularly with a four point support of such a structure. In four point supports, frequently considerable stresses are produced if the rails are not laid exactly in parallel, or if the hood side remote from the coke guide is held back or obstructed in its travel by any forces. Such transverse forces may cause a deformation of the travelling gear of the hood or even a derailment of rollers. These problems do not occur with the inventive structure.

At the point of support (C), the hood may bear against the coke guide through rollers and the support may be embodied by a track forming a fixed part of the coke guide. The hood may be moved independently and without additional equipment to a next coke guide. The track or rails might also be provided on a structure above the service passageway, for example on the extension platform.

Due to the invention, if repair work is wanted on the hood or the coke guide, there is no need for stopping the operation, a rapid change may be effected from one hood to the other, or from one coke guide to the other, without interrupting the coke discharge, or having other delays.

Accordingly a further object of the invention is to provide a gas collecting hood for collecting emission during the discharge of coke from a coke oven which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, the invention is explained in more detail with reference to the drawings in which.

DESCRIPTION OF THE PREFERRED EMBODIMENT

Figure 1:
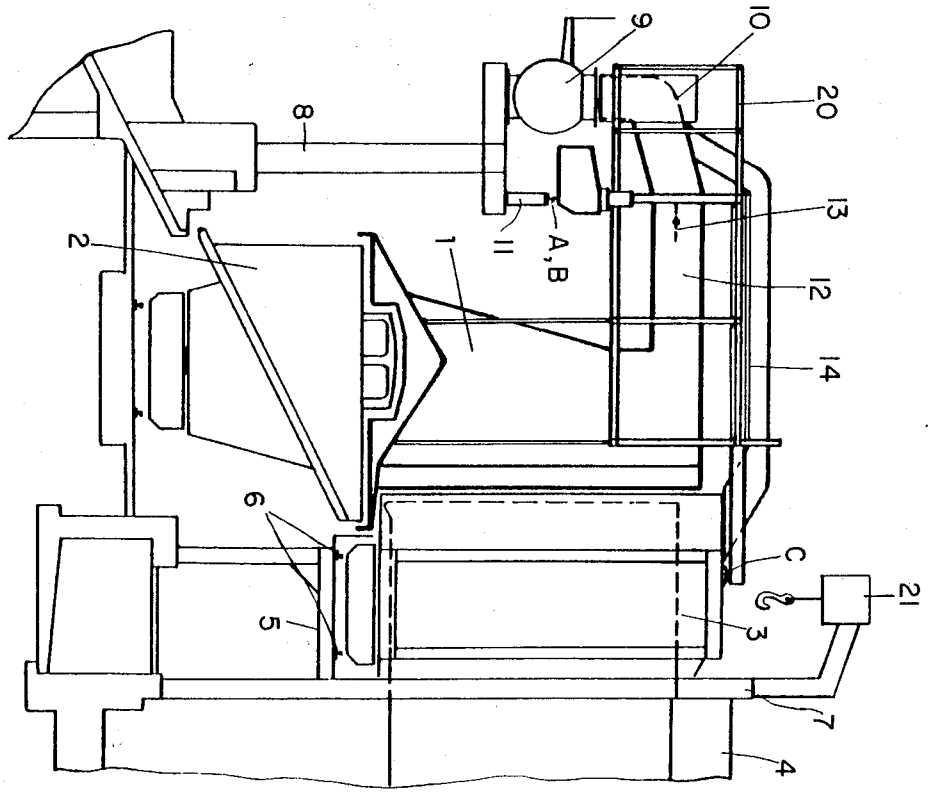
FIG. 1 is a diagrammatical view in the longitudinal direction of the coke oven battery, showing the inventive gas collecting hood and the coke guide at the coke side of the battery.
Figure 2:
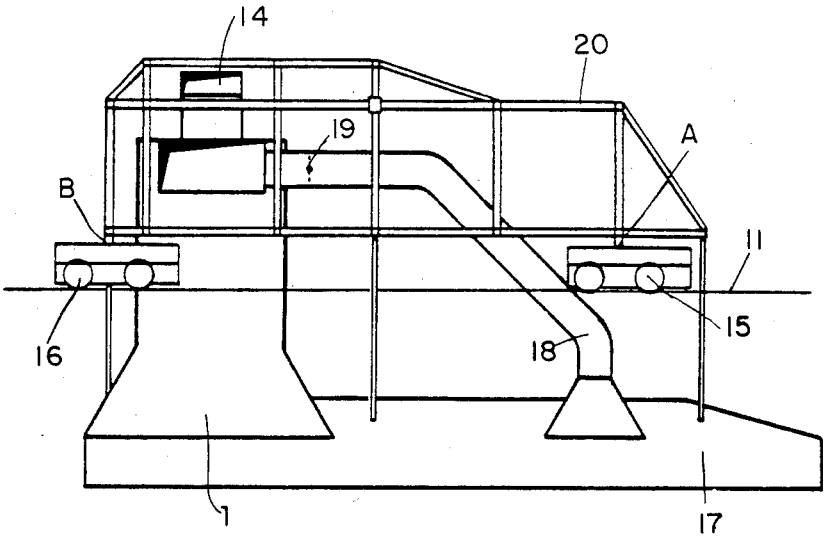
FIG. 2 is a similar view in the transverse direction of the battery.
Figure 3:
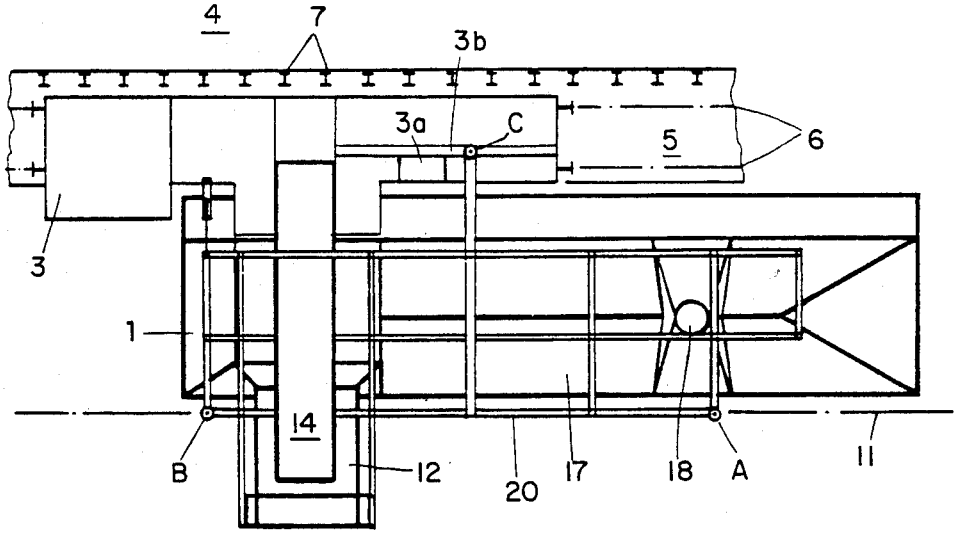
FIG. 3 is a top plan view corresponding to FIG. 2.

Referring to FIG. 1, the shown gas collecting hood 1 covers the entire quenching car 2 and is connected to the coke guide 3. The coke guide travels on the roof 5 of the service passageway, on rails 6, along the coke oven battery 4. For a discharge or pushing operation, the coke guide 3 is attached as gastightly as possible to the anchor posts 7 and the door opening of a coke oven, and connected, on the other side, through connection gates, to the upper portion of the hood, again as gastightly as possible. The hood 1 is supported, at its side remote from the coke guide, through rollers 15 and 16 on a rail 11, at points of support A and B. The rail is laid on a supporting structure 8 and extends in the longitudinal direction of the coke oven battery. Approximately at the same level, a gas collecting duct 9 is mounted on supporting structure 8, on which the travelling gear 10 moves in the longitudinal direction of the battery. Travelling gear 10 is connected through a connecting duct 12 directly to the upper portion of hood 1. A control valve 13 for controlling the intensity of exhaustion is provided in connecting duct 12. From the lower portions 17 of the hood, an exhaustion duct 18 connects to duct 12 which extends transversely thereto. The ratio of gas exhaustion through the upper and lower portions of the hood is in addition controlled by a valve 19. To be able to take off emissions which may occur above coke guide 3 or at the joint between the coke guide and the hood, an additional connecting duct 14 is provided above the hood, also extending over the major part of the coke guide. Duct 14 opens into duct 12 short of the location where duct 12 opens into the travelling gear 10. The entire hood is carried by a simple frame structure 20 resting against rail 11 at the two points of support A, B, and against the top of the coke guide 3 at a single support point C.

The support point C provides a pivotal connection between the hood frame 20 and the top of the coke guide 3. Support C may be formed of a ball-and-socket combination for univeral pivoting with the ball connected either to the frame 20 or to the top of the coke guide 3, and the socket being connected to the other element. Support C is near the center of the frame 20 on the side next to coke guide 3 and points A, B, are spaced apart on either side of the center and on an opposite side of the frame.

The rollers 15, 16 may also be provided with driving means for driving the hood on the rail 11 through support points A and B. These drives can be connected to a skew travel sensor **3*a* which is also connected to a drive of the coke guide 3 for the purpose of synchronizing the driving movement of the hood 1 and the coke guide 3. This prevents the hood from leading or trailing behind the guide 3** as the guide and hood move longitudinally along the coke oven battery.

A hoist schematically shown at 21 can also be connected to an extension platform over the coke guide for engaging the frame 20 of the hood 1 at the support point C, for lifting the hood from the guide 3.

Instead of providing a one point pivotal connection at support C between the frame 20 and the coke guide 3, a rail **3*b* can be attached to the top of the coke guide 3 and the support C can be provided with a roller for rolling on the track 3*b*. Track 3*b* extends in a longitudinal direction of the coke oven battery and permits relative movement and alignment between the hood 1 and the coke guide 3**.

While a specific embodiment of the invention has been shown and described in detail to illustrate the application of the principles of the invention, it will be understood that the invention may be embodied otherwise without departing from such principles.

Reference Numerals designate parts as follows:

1: a gas collecting hood;
2: quenching car;
3: coke guide;
4: coke oven battery;
5: roof of the service passageway;
6: rails for 3 on 5
7: anchoring post;
8: support for 1 and 9;
9: gas collector;
10: travelling gear;
11: rail on 8 for 1;
12: connecting point;
13: control valve;
14: additional connecting duct;
15: rollers of 1 travelling on 11;
16: rollers of 1 travelling on 11;
17: lower portion of the gas collecting hood;
18: take-off duct serving 17;
19: control valve in 18;
20: frame of 1;
A: point of support on rail 11 in the zone of 17;
B: point of support on rail 11 in the zone of the high portion of 1; and
C: point of support on coke guide 3.

What is claimed is:

1. In a coke oven battery having a coke guide mounted for movement in a longitudinal direction across the coke oven battery, the improvement comprising:

a support structure spaced laterally of the coke guide and extending in a longitudinal direction;

a rail mounted on said support structure extending in the longitudinal direction;

a gas collecting hood for collecting emissions during a discharge of coke from the coke oven battery over the coke guide;

a hood frame connected to said hood for supporting said hood;

two spaced apart roller means connected to said hood frame on a side of said hood frame and said hood remote from the coke guide, said roller means engaged on top of said rail for supporting said hood; and said hood frame including a single pivotal bearing means providing a one point support between said hood frame and the coke guide on a side of said hood frame and hood adjacent the coke guide whereby said hood is supported at three points, said frame being supported only at said roller means and bearing means, said pivotal bearing means comprising a bearing socket connected between said hood frame and the coke guide for universal pivoting, said bearing socket disposed on a top of the coke guide and near a center of said hood frame between said two roller means in the longitudinal direction.

2. The improvement of claim 1, wherein at least one of said two roller means include a drive, a further drive connected to the coke guide for driving the coke guide on the coke oven battery and a skew travel sensor connected to said drive of said roller means and said further drive of the coke guide for synchronizing the operation of said drives.

3. The improvement of claim 1, including a hoist connected to the coke oven battery for lifting said hood at said single pivotal bearing means from the coke guide.

4. In a coke oven battery having a coke guide mounted for movement in a longitudinal direction across the coke oven battery, the improvement comprising:

a support structure spaced laterally of the coke guide and extending in a longitudinal direction;

a rail mounted on said support structure extending in the longitudinal direction;

a gas collecting hood for collecting emissions during a discharge of coke from the coke oven battery over the coke guide;

a hood frame connected to said hood for supporting said hood;

two spaced apart roller means connected to said hood frame on a side of said hood frame and said hood remote from the coke guide, said roller means engaged on top of said rail for supporting said hood;

said hood frame including a single pivotal bearing means providing a one point support between said hood frame and the coke guide on a side of said hood frame and hood adjacent the coke guide whereby said hood is supported at three points, said frame being supported only at said roller means and bearing means, pivotal bearing means comprising further roller means connected to said hood frame near a center of said hood frame between said two spaced apart roller means in the longitudinal direction; and a further track fixedly mounted on top of the coke guide, said further roller means engaged on said further track, said further track extending in the longitudinal direction.

* * * * *